US005658394A

United States Patent [19]

Meroth

[11] Patent Number: 5,658,394

[45] Date of Patent: Aug. 19, 1997

[54] METHOD FOR INCREASING THE SURFACE HARDNESS OF LOOM COMPONENTS EXPOSED TO FRICTION

[75] Inventor: Klaus Meroth, Lindau, Germany

[73] Assignee: Lindauer Dornier Gesellschaft mbH, Lindau, Germany

[21] Appl. No.: 517,444

[22] Filed: Aug. 21, 1995

[30] Foreign Application Priority Data

Aug. 24, 1994 [DE] Germany ..... 44 29 943.5

[51] Int. Cl.[6] ..... C23C 8/26; C23C 8/38

[52] U.S. Cl. ..... 148/222; 148/239; 148/230; 148/318; 139/192; 428/667

[58] Field of Search ..... 148/230, 232, 148/239, 222, 318; 139/192; 428/667

[56] References Cited

U.S. PATENT DOCUMENTS 5,226,975 7/1993 Denton ..... 148/222

FOREIGN PATENT DOCUMENTS 0067098 12/1982 European Pat. Off. ..... 148/232
0550752 7/1993 European Pat. Off. .
2220859 12/1973 Germany .
0213460 8/1990 Japan ..... 148/222
671034 7/1989 Switzerland .
739131 6/1980 U.S.S.R. ..... 148/232

OTHER PUBLICATIONS

German Industrial Standard (DIN) Handbook No. 155 "Quality Standards for Steel and Iron No. 2", 1985, pp. 119 and 120, published by Beuthverlag GmbH Berlin and Cologne, Second Edition (DIN 17 224).

*Primary Examiner*—Deborah Yee
*Attorney, Agent, or Firm*—W. G. Fasse; W. F. Fasse

[57] ABSTRACT

Loom components such as reed dents or weft brake lamellae that, during operation, are exposed to frictional abrasion by a moving weft thread, are made of cold rolled strip steel or of refined nitrided steels. The components are then exposed to a heat treatment at a temperature larger than 480° C. for a duration of more than two hours, preferably up to 8 hours. A thermo-chemical treatment is performed simultaneously with the heat treatment to harden at least those surface areas of the components that in operation will be exposed to the frictional abrasion.

15 Claims, 1 Drawing Sheet

METHOD FOR INCREASING THE SURFACE HARDNESS OF LOOM COMPONENTS EXPOSED TO FRICTION

FIELD OF THE INVENTION

The invention relates to a method for improving or increasing the surface hardness of loom components exposed to friction during operation. Such components include, for example, reed dents and weft brake lamellae exposed in operation to a moving weft thread.

BACKGROUND INFORMATION

The reed in a loom, for example an air jet weaving loom, comprises a multitude of profiled reed dents that are assembled in and held by a reed frame including an upper and a lower reed frame rail. The upper ends of the reed dents are held in the upper rail while the lower reed dent ends are held in the lower rail. The plurality of the recesses, one of which is formed in each reed dent, form the weft thread insertion channel. The recesses have, for example a U-shaped configuration. The weft thread insertion channel is open toward the beat-up edge, whereby the back wall of the individual recess in each dent beats the weft thread against the beat-up edge to bind the weft thread into the fabric. Each recess in each dent also has an upper edge and a lower edge merging into the back wall. These edges and the back wall are exposed to frictional abrasion when the weft thread moves through the insertion channel. The back wall or back edge is especially exposed to wear and tear when the weft thread is beat up against the beat up edge. Thus, the surface areas forming the just mentioned edges are exposed to increased wear and tear, whereby conventional dents have a useful life time of about 1000 hours of operation. These considerations apply equally to the reed dents in a gripper loom in which the reed guides the grippers for the weft insertion.

The operational time of about 1000 hours requires making the reed dents of high quality alloyed steels. Yet reed dents made of such steels must be replaced after about 1000 hours of operation. Such replacement is undesirable, not only because it is increasing the costs of operating a loom, the replacement requires dead times in which the loom cannot produce.

Reed dents have been made heretofore of cold rolled strip steel made of steel selected from the group of X 12 CrNi 177; X 5 CrNiMo 1810; or X 7 CrNiAl 177. The details of the alloying components of these steels are described in information sheets of German Industrial Standards DIN 17224, February 1992. The dents are stamped out of the strip steel. These steels have a material strength of about 1200N/$mm^2$ providing a useful lifetime for the dents of about 1000 hours.

TABLE

Chemical Composition of the above Steels (Melt analysis)

| Steel Grades | | Chemical Composition (% by weight) (1) | | | | | | |
|---|---|---|---|---|---|---|---|---|
| Short Name | Material Number | C max. | Si max. | Mn max. | Al | Cr | Mo | Ni |
| X 12 CrNi 177 | 1.4310 | 0.12 | 1.5 | 2.0 | — | 16.0 to 18.0 | ≦0.8 | 6.0 to 9.0 |
| X 5 CrNiMo 18 10 | 1.4401 | 0.07 | 1.0 | 2.0 | — | 16.5 to 18.5 | 2.0 to 2.5 | 10.5 to 13.5 |
| X 7 CrNiAl 177 | 1.4568 | 0.09 | 1.0 | 1.0 | 0.75 to 1.50 | 16.0 to 18.0 | — | 6.5 to 7.75 |

(1) For all grades ≦0.045% P and ≦0.030% S.

German Patent Publication DE-OS 2,220,859 (Schreus et al.) published on Dec. 13, 1973, discloses a reed dent having a locally limited hardened zone. This zone is particularly limited to the edges or front surfaces of the dent. The hardened zones are made either by a localized hardening or by coating these areas with a hard material if the steel of the dent itself is made of ordinary, non-refined steels. However, details of achieving the localized hardened areas are not disclosed. It has been found that the intended increase of the useful operating time of dents has not been achieved if the hardening in localized areas takes place conventionally.

It is also known to treat reed dents galvanically, for example to achieve a hard chrome galvanically deposited coating. Conventional dents having a thickness within the range of about 0.15 mm to about 0.8 m mare provided with a hard chrome coating having a coating thickness of about 10 μm. This coating has a hardness according to Vickers of about 700 HV. These hard chrome coatings increase the useful life of the dents to twice the hours normally achieved. This holds true even when the weft threads have a substantial abrasive quality. Weft threads such as jute, fiberglass yarns, fiberglass rovings and the like have such abrasive characteristics.

It has been found that reed dents provided with a hard chrome coating require a surface treatment following the coating in order to provide a smooth surface. The chrome coating itself results in a rough surface at the upper and lower edges and the back wall edge forming the individual recess in each dent. Performing the surface coating by galvanic deposition for example in these areas involves additional efforts and expense.

Swiss Patent Publication CH-PS 671,034 (Ischii et al.) published on Jul. 31, 1989, discloses machine components exposed to elongated fibrous members such as yarns or threads used in a loom, knitting machines, and the like. The exposed components are, for example heddles, relay nozzles, reed dents, and the like made of stainless steel and coated with a chrome oxide $Cr_2O_3$ layer. The coating is made by dipping the components into a solution containing chrome, for example an aqueous solution of $CrO_3$ to coat the components, whereupon a heat treatment is performed to achieve a reaction in a temperature range of about 500° to 600° C., whereby a surface coating is formed in which the main coating proportion is $Cr_2O_3$.

Swiss Patent Publication 671,034 further discloses that a porous ceramic layer may be formed by applying a coating of a chrome containing composition including abrasion resistant particles such as aluminum oxide $Al_2O_3$ or silicon oxide $SiO_2$ particles. These treatments achieve a Vickers hardness of 500 HV or more. As is generally known, chrome coatings have a Vickers hardness of about 700 HV but require an after-treatment as mentioned above. Such an after-treatment should be avoided.

European Patent Publication 0,550,752 (Miya et al.) published on Jul. 14, 1993 discloses a reed for a high speed loom. The dents of the reed are provided with a diamond-like carbon (DLC) coating or film on dents made of stainless steel. First, the dents are provided with an intermediate coating for improving the bonding of the diamond-like carbon film on the surface of the dents. The bonding improving coating is a titanium carbide alloy. Once the intermediate coating has been applied, the diamond-like carbon film is applied by chemical vapor deposition in a reaction chamber at a certain pressure and certain temperature under which the dents are contacted by a hydrocarbon gas providing the source for the diamond-like carbon. It has, however, been found that the diamond-like carbon film does not provide the expected improvement in the wear resistance, the fatigue strength, and the alternating bending strength of the dents. Thus, even this approach leaves room for improvement.

It is further known from a German Industrial Standard (DIN) Handbook No. 155 "Quality Standards for Steel and Iron" No. 2, 1985, pages 119 and 120, published by Beuth-verlag GmbH Berlin and Cologne, Second Edition, that the material strength can be increased for the above mentioned steel types by a heat treatment involving a single aging or annealing operation or by a double aging or annealing operation. For example, it is possible to obtain a material strength of 1400N/mm$^2$ if the dents are made of X 7 CrNiAl 177 steel having a thickness of 0.75 mm if the heat treatment takes place at a temperature within the range of 480° C. to 550° C. for a duration of 1 to 2 hours at the most. This treatment results in a 15 to 25% increase in the material strength as compared to that of a steel of the same chemical composition, but without heat treatment.

In connection with the manufacture of tools, it is also known to provide the tool surfaces with a thin layer of high hardness, for example a titanium nitride layer. These layers are deposited out of the gas phase by ion implantation or by a sputtering deposition. The hard surface layers are relatively thin, yet expensive to form. Due to the large number of required reed dents it would appear that these methods are not suitable for the manufacture of reed dents or other loom components exposed to frictional abrasion such as weft thread brake lamellae.

OBJECTS OF THE INVENTION

In view of the above it is the aim of the invention to achieve the following objects singly or in combination:

- to increase the useful life of loom components such as reed dents and weft brake lamellae which are made of the following steels X 12 CrNi 177, X 5 CrNiMo 1810 or X 7 CrNiAl 177 which are provided as cold rolled strip steel that is resistant to tempering;
- to increase the useful life of such components by several times compared to conventional methods in which the hardness at the surface areas exposed to abrasion is not achieved by a separate surface coating;
- to localize the substantially increased hardness to those surface areas of reed dents and weft brake lamellae that are exposed to frictional abrasion while the remaining areas of the component remains unhardened; and
- to increase the hardness even of reed dents and weft brake lamellae which have been provided with a hard chrome coating.

SUMMARY OF THE INVENTION

Where the reed dents are made of steel selected from the group consisting of X 12 CrNi 177; X 5 CrNiMo 1810; or X 7 CrNiAl 177 that are resistant to tempering, the following steps are performed according to one aspect of the invention. First, the reed dents are held in a package that leaves surface areas to be hardened exposed, second, temperature treating the reed dents at a temperature within the range of 480° C. to 550° C. for a duration of more than 2 hours, preferably up to about 8 hours, third, flowing during the heat treatment a nitration gas flow into contact with the exposed dent surface areas, and fourth, the so treated reed dents are cooled down to room temperature.

In a modified treatment according to the invention the heat treating is performed in a reaction space that is evacuated at least partly sufficient for performing a plasma nitration step which is carried out simultaneously with the heat treating step. The nitrating with the nitration gas flow such as ammonia or a plasma nitration step is performed for a duration that may be the same as the heat treatment or it may be shorter than the heat treatment duration of preferably up to 8 hours.

According to a further aspect of the invention reed dents and/or weft brake lamellae made of steel selected from the group X 12 CrNi 177, X 5 CrNiMo 1810 or X 7 CrNiAl 177 and that have been hard chrome plated, may be further improved by an ion implantation step at least on those hard chrome plated surface areas intended for an abrasive exposure to a moving weft thread.

The first two methods according to the invention are preferably performed in a reaction space preferably at a reduced pressure within the range of 1 to 10 mb in which the heat treatment and the thermo-chemical reaction treatment are performed simultaneously for achieving a high wear and tear resistance on the localized surface areas around the edges and back wall edge of the recess of a reed dent. Preferably, the nitration takes place by ionizing the nitrogen in a glow discharge to obtain a plasma nitration. It has been found that reed dents treated according to the invention have a Vickers hardness in the treated areas up to 1200 HV.

The remaining surface areas of the reed dents or weft brake lamellae are not provided with the improved hardness surface layer, whereby the danger that a dent or lamella might break during use in a loom is eliminated or greatly reduced.

The first two aspects of the invention avoid the application of a separate hard surface layer altogether. Rather, the two first aspects of the invention improve the material of which the dents are made only in those areas which are exposed most to the wear and tear namely the edges forming the recess in each dent. The combined heat treatment and thermo-chemical treatment by gas nitration or plasma nitration achieves a high wear resistance in the areas where needed at reasonable costs.

Compared to a separate hard coating layer the diffusion layer provided according to the invention provides a higher wear and tear resistance and a higher fatigue strength as well as a higher alternating bending strength than obtained in reed dents of the same structure, but provided with hard coatings. Due to the heat treatment in combination with the simultaneous nitration treatment, especially the plasma nitration treatment of the reed dents in packaged form, it becomes possible that the individual dents remain absolutely straight and only a hard diffusion layer is formed on the surface portions or rather edges that are exposed outside a packaging frame or holding jig.

It has also been found that a further ion implantation step following the heat treatment and nitrating step results in a further increase of the wear resistance, whereby preferably nitrogen atoms are ion implanted. The final hardness in the edge areas of the dents is then about 1800 HV.

Practice of the third aspect of the invention, teaching an ion implantation into a hard chrome coating layer, for example of nitrogen atoms into the hard chrome coating layer, results in a five-fold increase of the operational life of the so treated reed dents and the so treated weft brake lamellae compared to corresponding components having only a hard chrome coating.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
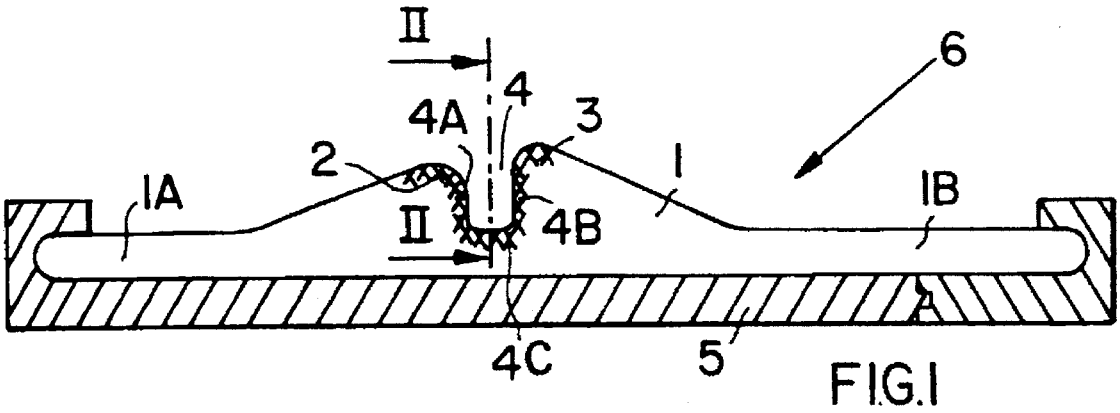
FIG. 1 shows a side view of a reed dent with a mounting frame or jig for holding the dents shown in section.

In FIG. 1 a plurality of reed dents 1 are held in place in a mounting frame or jig 5 to form a package of closely packed dents for the treatment according to the invention. The outer contour 6 of the individual dents 1 is formed by the upwardly facing edges of an upper dent section 1A having a first projection 2 and by a lower dent section 1B having a second projection 3. The projections 2 and 3 form a recess 4. All recesses 4 of all dents 1 together form a weft insertion channel once these dents are inserted into a reed frame not shown. After the present treatment the dents 1 are removed from the holding frame 5 in which the dents 1 are closely packed in contact with each other during the combined heat and thermo-chemical treatment. The recess 4 has a somewhat U-shaped configuration surrounded by edges 4A and 4B as well as by a back wall edge 4C.

When particularly abrasive weft thread material is being used such as glass rovings, the contour 4A is especially exposed to abrasive wear and tear. Similarly, the back wall edge 4C is exposed to wear and tear especially during beat-up.

For achieving an efficient and cost effective thermal and thermo-chemical treatment as taught by the invention it is suggested that the multitude of dents 1 made, for example of cold rolled strip steel of the type X 12 CrNi 177 formed by stamping are packaged in the frame 5 or in a steel ribbon coil. The so-formed package is then inserted into a reaction space not shown. The reaction space is evacuated, preferably to a reduced pressure within the range of 1 to 10 mbar and heated to a temperature larger than 480° C., but preferably not exceeding 550° C. The heat treatment duration is more than 2 hours, but preferably about 8 hours. Simultaneously, or in parallel with the heat treatment, the surface contour 6 formed by the upwardly facing edges of the dents 1 are exposed to a nitriding gas such as pure nitrogen which is preferably ionized by a glow discharge to provide a plasma for the nitration. During the nitration while simultaneously heat treating the dents the nitrogen atoms diffuse into the freely accessible surface contour 6 and form a hard diffusion layer 7 shown in FIG. 2. The diffusion layer 7 has a thickness of about 0.1 mm. Ammonia gas or any other suitable source of nitrogen may be used. Following the heat and nitration treatment, the package is cooled down to room temperature, preferably at a cooling rate of about 50° C. per hour.

Following the cooling, the dents are preferably further treated by an ion implantation in the evacuated reaction space. The ion implantation is preferably limited to the edge areas 4A, 4B and 4C. The duration of the ion implantation takes about 4 hours. The ion implantation forms a further surface layer 8 having a thickness of about 10 μm. The implantation surface layer 8 on the diffusion layer 7 is relatively harder than the diffusion layer 7. It should be noted here, that the heat treatment and the nitration in a nitration gas flow does not necessarily have to take place in an evacuated reaction chamber, it is sufficient if the reaction chamber is heated to the required temperatures.

Figure 2:
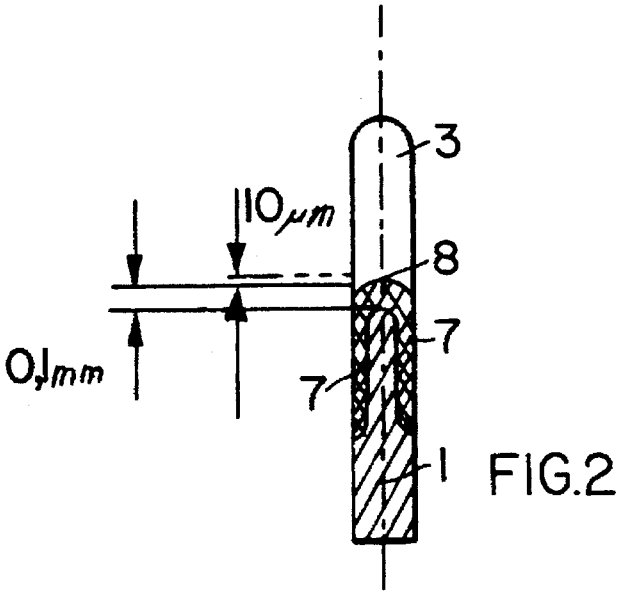
FIG. 2 is a sectional view along section line II—II in FIG. 1.

FIG. 2 shows in a sectional view the location of the diffusion nitration layer 7 having a thickness of about 0.1 mm and covered at least one the back wall 4C by an ion implantation layer 8 having a thickness of about 10 μm on top of the diffusion layer 7 having a thickness of about 100 μm.

Figure 3:
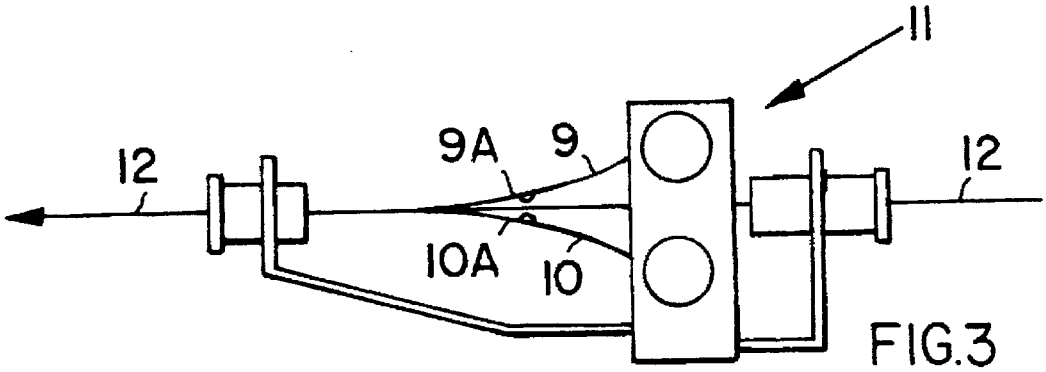
FIG. 3 is a view onto a pair of weft brake lamellae in a weft brake with surface areas treated according to the invention.

FIG. 3 shows a top plan view of a weft brake 11 for a weft thread 12. The brake comprises a pair of weft brake lamellae 9 and 10 having surfaces 9A and 10A facing each other. These facing surfaces 9A and 10A are provided with a hard chrome coating, for example by galvanic deposition. The hard chrome coating is further improved according to the invention by an ion implantation into the hard chrome coating on the surface areas 9A and 10A. It has been found that lamellae having only a hard chrome coating have a Vickers hardness of about 700 HV and a useful lifetime of about 1000 hours. However, surprisingly after ion implantation into the hard chrome coating the useful life of the weft brake lamellae could be increased five-fold as compared to brake lamellae having a hard chromium coating on the surfaces 9A and 10A, but without any ion implantation.

Although the invention has been described with reference to specific example embodiments, it will be appreciated that it is intended to cover all modifications and equivalents within the scope of the appended claims.

What is claimed is:

1. A method for increasing a surface hardness of loom reed dents to be exposed to abrasive friction by a weft thread, comprising the following steps, (a) making said reed dents of steel selected from the group consisting of X 12 CrNi 177, X 5 CrNiMo 1810, and X 7 CrNiAl 177, (b) holding said reed dents in a package that leaves surface areas to be hardened exposed, (c) heat treating said reed dents at a temperature within the range of 480° C. to 550° C. for a duration of about at least two hours to about eight hours, (d) flowing, during said heat treating, nitriding gas flow into contact with said exposed surface areas for nitriding said surface areas, and (e) cooling said reed dents down to room temperature.

2. The method of claim 1, wherein said nitriding gas flow is an ammonia gas flow.

3. The method of claim 1, wherein said heat treating and said nitriding gas flow are maintained simultaneously for the same duration.

4. The method of claim 1, further comprising an ion implantation step at said room temperature on said exposed surface areas following said heat treating and said nitriding.

5. The method of claim 4, wherein said ion implantation step involves the implantation of nitrogen (N) atoms.

6. A method for increasing a surface hardness of loom reed dents to be exposed to abrasive friction by a weft thread comprising the following steps, (a) making said reed dents of steel selected from the group consisting of X 12 CrNi 177, X 5 CrNiMo 1810, and X 7 CrNiAl 177, (b) holding said reed dents in a package that leaves surface areas to be hardened exposed, (c) heat treating said reed dents at a temperature within the range of 480° C. to 550° C. for a duration of about at least two hours to about eight hours in a reaction space, (d) evacuating said reaction space at least partly sufficient for performing a plasma nitriding step, (e) performing said plasma nitriding step simultaneously with said heat treating step, and (f) cooling said loom reed dents to room temperature.

7. The method of claim 5, wherein said evacuating step establishes in said reaction space a reduced pressure within the range of 1 to 10 millibar.

8. The method of claim 6, wherein said plasma nitriding step is performed by flowing a nitrogen containing gas into said reaction space at a reduced pressure.

9. The method of claim 6, further comprising an ion implantation at said room temperature on said exposed surface areas following said heating and plasma nitriding step.

10. A method for increasing a surface hardness of one of loom reed dents and weft brake lamellae, comprising the following steps:

(a) making said reed dents and said weft brake lamellae of steel selected form the group consisting of X 12 CrNi 177, X 5 CrNiMo 1810, and X 7 CrNiAl 177 steels, (b) hard chrome plating said reed dents and said weft brake lamellae, and (c) performing an ion implantation step at least on hard chrome plated surface areas intended for abrasive exposure to a moving weft thread.

11. The method of claim 10, wherein said ion implantation step involves the implantation of nitrogen (N) atoms.

12. The method of claim 10, comprising assembling said loom reed dents in a package following said hard chrome plating and prior to said ion implantation step so that said surface areas intended for said abrasive exposure are accessible for said ion implantation step.

13. A loom reed dent having a surface intended to be exposed to abrasive friction by a weft thread, produced by the following steps:

(a) making said reed dent of steel selected from the group consisting of X 12 CrNi 177, X 5 CrNiMo 1810, and X 7 CrNiAl 177, (b) holding said reed dent in a package that leaves surface areas to be hardened, exposed, (c) heat treating said reed dent at a temperature within the range of 480° C. to 550° C. for a duration of about at least two hours to about eight hours, (d) flowing, during said heat treating, a nitriding gas flow into contact with said exposed surface areas for nitriding said surface areas, and (e) cooling said reed dent down to room temperature.

14. A loom reed dent having a surface intended to be exposed to abrasive friction by a weft thread, produced by the following steps:

(a) making said reed dent of steel selected from the group consisting of X 12 CrNi 177, X 5 CrNiMo 1810, and X 7 CrNiAl 177, (b) holding said reed dent in a package that leaves surface areas to be hardened exposed, (c) heat treating said reed dent at a temperature within the range of 480° C. to 550° C. for a duration of about at least two hours to about eight hours in a reaction space, (d) evacuating said reaction space at least partly sufficient for performing a plasma nitriding step, (e) performing said plasma nitriding step simultaneously with said heat treating step, and (f) cooling said loom reed dent to room temperature.

15. A loom component selected from the group of reed dents and weft brake lamellae having a surface intended to be exposed to abrasive friction by a weft thread, produced by the following steps:

(a) making said loom component of steel selected from the group consisting of X 12 CrNi 177, X 5 CrNiMo 1810, and X 7 CrNiAl 177 steels, (b) hard chrome plating said loom component, and (c) performing an ion implantation step at least on hard chrome plated surface areas.

* * * * *